US006154111A

United States Patent [19]

Rehm et al.

[11] Patent Number: 6,154,111

[45] Date of Patent: Nov. 28, 2000

[54] STORAGE COIL

[75] Inventors: Markus Rehm; Thomas Riesle; Jose-I. Rodriguez-Duran, all of Villingen-Schwenningen, Germany

[73] Assignee: Deutsche Thomson-Brandt GmbH, Villingen-Schwenningen, Germany

[21] Appl. No.: 09/288,180

[22] Filed: Apr. 8, 1999

[30] Foreign Application Priority Data

Apr. 27, 1998 [DE] Germany ..... 198 18 673

[51] Int. Cl.[7] ..... H01F 27/04; H01F 27/30

[52] U.S. Cl. ..... 336/83; 336/178; 336/192; 336/200; 336/223

[58] Field of Search ..... 336/223, 200, 336/232, 83, 192, 178

[56] References Cited

U.S. PATENT DOCUMENTS

| | | | |
|---|---|---|---|
| 267,138 | 11/1882 | Blanchard | 336/223 |
| 316,354 | 3/1885 | Gauland et al. | 336/223 |
| 3,765,092 | 10/1973 | Zyetz | 29/602 |
| 3,812,442 | 5/1974 | Muckelroy | 336/83 |
| 4,129,846 | 12/1978 | Yablochnikov | 336/84 |
| 4,641,114 | 2/1987 | Person | 336/200 |
| 5,179,365 | 1/1993 | Raggi | 336/223 |
| 5,184,103 | 2/1993 | Gadreau et al. | 336/84 |
| 5,345,670 | 9/1994 | Pitzele et al. | 29/606 |
| 5,559,487 | 9/1996 | Butcher et al. | 336/178 |
| 5,726,615 | 3/1998 | Bloom . | |

FOREIGN PATENT DOCUMENTS

| | | |
|---|---|---|
| 0035964 | 9/1981 | European Pat. Off. . |
| 0293617 | 12/1988 | European Pat. Off. . |
| 0337191 | 10/1989 | European Pat. Off. . |
| 0671749 | 9/1995 | European Pat. Off. . |
| 2476898 | 2/1980 | France . |
| 2520934 | 11/1976 | Germany . |
| 19522043 | 12/1996 | Germany . |
| 29707106 | 8/1997 | Germany . |
| 3-78218 | 4/1991 | Japan . |
| 1180923 | 2/1970 | United Kingdom . |

OTHER PUBLICATIONS

Search Report for German Patent Appln. No. 198 18 673.8.

Eisler, Paul: Gedruckte Schaltungen, Carl Hanser Verlag, Munchen, 1961, S. 272,273.

*Primary Examiner*—Thomas J. Kozma

*Attorney, Agent, or Firm*—Joseph S. Tripoli; Joseph J. Laks; Daniel E. Sragow

[57] ABSTRACT

The storage coil has a core and windings which are arranged as conductor tracks on base layers. The base layers each contain only one winding, whose start and end are each passed out on one or more projections on the outer edge of the base layer. In consequence, the projections project out of an opening in a core, for example an E/I core, on which projections the windings of the base layers make contact with one another and with connections. With suitable dimensioning, losses resulting from the skin effect and eddy current losses can be kept very low.

6 Claims, 1 Drawing Sheet

STORAGE COIL

BACKGROUND

The invention is based on a coil having a core and windings which are arranged as conductor tracks on base layers.

Coils or transformers which are operated, in particular, at frequencies of more than 100 kHz and are designed as power components are considerably influenced, in terms of their electrical characteristics, by the skin effect. Since, depending on the frequency, the skin effect means that currents flow only in the outer layer of a conductor, wires or conductor tracks cannot be made appropriately thicker to deal with higher power levels so that, for example, copper braids have to be used instead of a wire. However, even when copper braids are used in coils of a convention types which are used in switched-mode power supplies at frequencies of, for example, 500 kHz, their temperatures are more than 100° C. and their losses are several watts during operation. The use of copper sheet with an insulating layer located in between is more costly, and is likewise still subject to an extreme temperature rise of 60° C. at 500 kHz.

Application Note Philips Magnetic Products, "Design of Planar Power Transformers" discloses the use of a board technique in a power transformer for relatively high frequencies. In this case, a plurality of double-sided boards are located one above the other, and each board contains a plurality of windings, whose inner end is plated through in order to connect the windings to one another. The boards have a hole in the centre, through which the core is passed, so that there is a closed magnetic circuit in the core.

The object of the present invention is to specify a coil of the type mentioned initially which has low electrical losses with compact dimensions.

BRIEF SUMMARY OF THE INVENTION

The coil according to the invention contains base layers, which each contain only one winding, in which case the start and end of each winding are passed out on one or more projections on the outer edge of the base layer, so that a plurality of base layers can make contact with one another via these projections. The base layer may be a thin board, a substrate as is normally used for RF technology, or a plastic sheet, to which the one winding is applied as a conductor track, in particular as a copper conductor track by etching techniques.

The windings on the base layers can be conductively connected to one another in a simple manner, for example in one process step by immersion in a solder bath. To this end, a start and an end of a winding on a projection have different lengths, and a plurality of base layers are laid one on top of the other in such a manner that the start and end of adjacent base layers overlap one another. After making contact, the windings are then all connected in series. E/I-, U/U-, R/M- or E/E-ferrite cores, for example, are suitable for use as the core. The base layers can be arranged in these cores without any coil former being required. Such cores normally have one or two openings, in which the projections of the base layers are arranged. If the location of an opening is occupied by the projections which are located one next to the other, then it is possible to use a shortened winding and to shift a projection through about 90° at the edge to go back to the second opening or to the start of the first opening.

The coil is particularly suitable for applications as a frequency-determining component in resonant circuits in switched-mode power supplies which use the resonant-converter principle and which operate at frequencies of more than 100 kHz. Other applications, for example in telecommunications, are likewise possible, however.

BRIEF DESCRIPTION OF THE DRAWINGS

The invention will be explained in more detail in the following text with reference, by way of example, to schematic drawings, in which.

DESCRIPTION OF THE PREFERRED EMBODIMENTS

Figure 1:
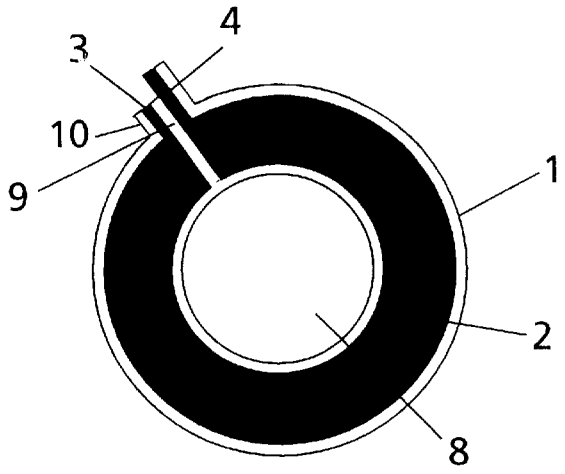
FIG. 1 shows a base layer with one winding.

A winding 2 is arranged, so to speak as a winding, with a start 3 and an end 4 on the base layer 1 in FIG. 1. The start 3 and end 4 lie on a projection 10 on the outer edge of the base layer. The base layer 1 is, for example, a thin board, a substrate or a plastic sheet, to which the winding 2 is applied as a conductor track, for example using a copper etching technique. In this exemplary embodiment, the base layer 1 is round and contains a hole 8 in the centre for a core to pass through, although other embodiments are likewise possible. The conductor track 2 is circular and contains a narrow slot 9 between the start 3 and the end 4, by means of which the start 3 and the end 4 are isolated from one another. The short end of the projection 10 is, for example, 2.5 mm long, and the long end is, for example, 4.5 mm long.

Figure 2:
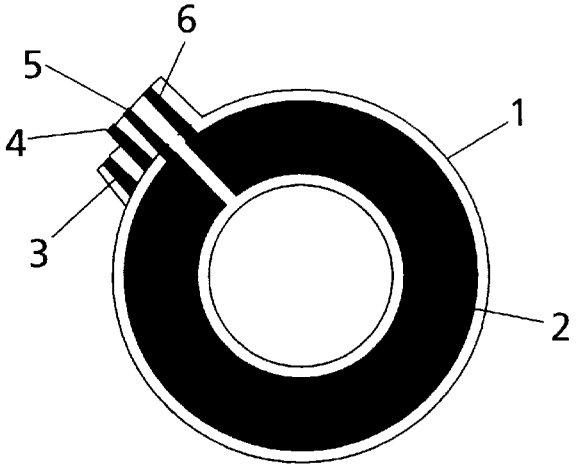
FIG. 2 shows three base layers which are located one above the other and make contact.

The start 3 with the associated projection 10 of the base layer 1 is somewhat shorter than the end 4, so that base layers can be placed one on top of the other in such a manner that one end of one winding overlaps the start of the next winding. To this end, a slight rotation between the base layers is necessary, as is shown in FIG. 2. This figure shows three base layers, in the case of which a start and an end respectively overlap, and which are soldered to one another.

Only the start 3 of the bottom base layer is visible. The start 4 of the next base layer is located above the end of this base layer, and its own end is overlapped by the start 5 of the third base layer. This arrangement allows the windings to be connected to one another in one process, for example by immersion in a solder bath, so that all the windings are connected in series to produce a coil winding having a start 3 and an end 6. However, other connection techniques are likewise possible.

Since the base layers 1 have an electrical conductor on only one side, the windings 2 are adequately isolated from one another by the base layers, so that there is no need for any further insulation material. In consequence, for example, 20 base layers, corresponding to 20 windings, may be arranged directly in one core, with appropriate dimensioning. No coil former is required.

The conductor tracks have, for example, a thickness of 35 $\mu$m and have a low electrical resistance at frequencies above 100 kHz. For example, a coil with 20 windings and 70 $\mu$H has a resistance of only 0.6 ohms at a frequency of 500 kHz, which leads only to a relative temperature rise of 30° C. The thickness of a base layer 1 in this case is 0.1 mm.

Figure 3:
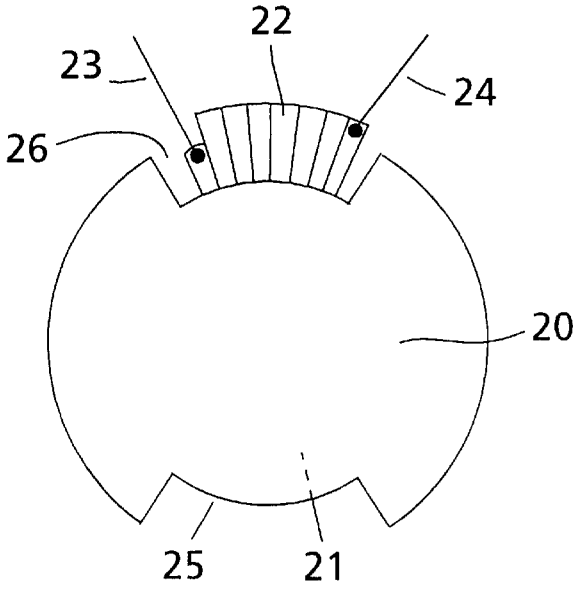
FIG. 3 shows a coil with an E/I core and base layers.

FIG. 3 shows a plan view of a coil with a core 20 and windings on base layers 21 which are arranged in the core. Only the projections 22 from the base layers 21 are visible, on which projections 22 the contacts are made between the respective end and the start of the next winding. The coil is connected to a circuit via connections 23, 24. By rotating or shifting a projection, in this exemplary embodiment through about 90°, it is also possible to use the second opening 25 in the E/I core for making contact. Alternatively, a second level can also be fitted above the projections 22. In cases such as this, only a quarter, half or three quarters of a winding, for example, is arranged on this base layer instead of a complete winding. This base layer then contains, for example, one projection, which projects out of the opening 26, and one projection, which projects out of the opening 25 with the respective start or end of the winding.

In one exemplary embodiment, the coil contains, for example 20 windings and achieves 70 $\mu$H with an RM12 core. The conductor tracks utilize the width of the base layer as completely as possible, in order to keep the radio-frequency resistance as low as possible. In this exemplary embodiment, it is only 0.6 ohms for the coil. Since the coil is designed as a storage coil whose core has an air gap, in order to store energy, it is also still subject to losses from eddy currents. If an E/I core is used, the losses can be reduced further by arranging the base layers on the other side of the gap in the core 20 with the use of a spacer, and in consequence as far away from them as possible.

Parallel circuits of windings are likewise possible: for example two sets of 10 windings can be connected in series, and these series circuits can then be connected in parallel, thus effectively producing 10 windings with a relatively low electrical resistance.

Other advantages of the coil are that no coil former is required and the use of ecologically undesirable varnished copper wire is avoided. Rolled copper can be applied directly onto a plastic sheet. The recycling capability with such planar technology is therefore no problem. Once the coil has been chopped up, the ferrite core can be separated out magnetically, and the copper electrically. All that then remains is the plastic sheet, which can be reused, depending on the material used. In contrast to this, a coil wound with braid can be disposed of only in a waste dump.

The coil which has been described with reference to FIGS. 1–3 is designed in particular as a storage coil for relatively high power levels. Other embodiments for corresponding applications are evident to a person skilled in the art. In particular, the geometry of the base layers 1, of the conductor track 2, and of the projections 10 may be designed geometrically as required, depending on the configuration.

What is claimed is:

1. Coil having a core and having windings which are arranged as conductor tracks on plane base layers stacked on a core, said base layers containing one winding each whose start and whose end are each passed out on a projection on the outer edge of said base layers, said two projections of a base layer having different lengths, adjacent base layers being twisted with respect to one another in that the shorter projection overlaps with the longer projection for providing an overlap of an end of a winding with the start of the next winding, and the start and the end of said windings being each conductively connected with one another.

2. Coil according to claim 1, characterized in that the base layer is one of a group consisting of a board, a substrate and a plastic sheet, to which the winding is applied as a conductor track.

3. Coil according to claim 1, characterized in that the core is one of a group consisting of an E/I-, U/U-, R/M- and E/E-ferrite core, which holds the base layers (1).

4. Coil according to claim 1, characterized in that the core has an air gap, and in that the base layers are spaced apart from the air gap.

5. Coil according to claim 1, characterized in that a start of a winding of a base layer is rotated through about 90°, with respect to the end of the adjacent base layer.

6. Coil according to claim 1, characterized in that said windings are conductively connected by soldering.

* * * * *